US007448617B2

(12) United States Patent
Fujioka et al.

(10) Patent No.: US 7,448,617 B2
(45) Date of Patent: Nov. 11, 2008

(54) TRAY AND RECORDING APPARATUS

(75) Inventors: Kazuyuki Fujioka, Nagano (JP); Kenichi Miyazaki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 270 days.

(21) Appl. No.: 10/834,363

(22) Filed: Apr. 29, 2004

(65) Prior Publication Data

US 2005/0052517 A1 Mar. 10, 2005

(30) Foreign Application Priority Data

May 1, 2003 (JP) ..... P2003-126169

(51) Int. Cl.
*B65H 31/00* (2006.01)

(52) U.S. Cl. ..... 271/207; 271/213; 271/220; 347/104

(58) Field of Classification Search ..... 271/207, 271/213, 214, 220, 10.11; 347/104; 399/385, 399/405

See application file for complete search history.

(56) References Cited

U.S. PATENT DOCUMENTS 4,364,553 A * 12/1982 Wilson ..... 271/219
5,280,897 A * 1/1994 Maekawa ..... 271/3.03
5,350,169 A * 9/1994 Hiroi et al. ..... 271/213
5,918,873 A * 7/1999 Saito et al. ..... 271/10.11
6,158,733 A * 12/2000 Muraki ..... 271/127

FOREIGN PATENT DOCUMENTS

| | | |
|---|---|---|
| JP | 10-250896 A | 9/1998 |
| JP | 11-124271 A | 5/1999 |
| JP | 200172303 A | 3/2001 |

* cited by examiner

*Primary Examiner*—David H. Bollinger
(74) *Attorney, Agent, or Firm*—Sughrue Mion, PLLC

(57) ABSTRACT

A discharge tray includes a guide portion that is retractable or extendable, relative to medium stacking portions, in consonance with the form of the recording media that are to be discharged. When the recording media that are to be discharged have a predetermined form, the guide portion at the medium stacking portion is prepared so as to guide a recording medium from a discharge portion to the medium stacking portion. With this arrangement, when recording media are so formed that arranging them on the medium stacking portion is difficult, the recording media can be guided from the discharge portion to the medium stacking portion, where they can be stacked accurately.

13 Claims, 15 Drawing Sheets

TRAY AND RECORDING APPARATUS

The present application is based on Japanese Patent Application No. 2003-126169, the entire contents of which are incorporated herein by reference.

BACKGROUND OF THE INVENTION

1. Field of the Invention

The present invention relates to a tray on which recording media, after being discharged, are mounted, a recording apparatus with which this tray is equipped, and a liquid ejection apparatus.

2. Related Art

Of the large recording apparatuses that are presently being marketed, an ink-jet printer is available that can print recording media ranging in size from, for example, A4 to comparatively large sizes, such as A2, all of which conform to the JIS standards. Since this ink-jet printer handles batches of heavy paper, unlike a small ink-jet printer, it is difficult for paper to be supplied from the rear and discharged at the front, the supply and discharge of paper is performed from the front. That is, a paper supply tray and a paper discharge tray are provided on the front face of an ink-jet printer (see JP-A-11-124271).

A discharge tray is located below a discharge roller, and when paper sheets of various sizes are discharged they are stacked on this tray. However, an ink-jet printer also prints paper supplied as a roll, and since when paper supplied as a roll is discharged it is curled in the discharge direction, the leading edge of the paper roll sheet can be caught between the discharge roller and the discharge tray. Accordingly, stacking paper sheets supplied as a roll on the discharge tray is difficult.

SUMMARY OF THE INVENTION

To resolve these shortcomings, it is one objective of the present invention to provide a tray on which a variety of discharged recording medium types can be stacked, a recording apparatus equipped with such a tray, and a liquid ejection apparatus.

To achieve these objectives, according to the invention, a tray on which discharged recording media are stacked comprises:

a guide portion, being retractable into or extendable from a medium stacking portion in accordance with the form of the medium to be discharged, and when the medium to be discharged has a predetermined form, being extended from the medium stacking portion so as to guide the medium from a discharge portion to the medium stacking portion. With this arrangement, when the form of a recording medium is such that stacking the medium on the stacking portion is difficult, the recording medium can be guided from the discharge portion to the medium stacking portion. Therefore, the recording medium can be precisely stacked on the medium stacking section.

When the recording medium is flat, the guide portion is retracted into the medium stacking portion, and when a recording medium is curled in the discharge direction, the guide portion is positioned at the medium stacking portion. With this arrangement, a flat recording medium can be stacked directly on the medium stacking portion, or a curled recording medium can be discharged to the medium stacking portion without being caught between the discharge portion and the medium stacking portion. For the guide portion, a slanted member is included that guides a recording medium from the discharge portion down to the medium stacking portion. With this arrangement, the leading edge of the recording medium can slide along the slanted member, which is shaped like a playground slide, and the leading edge of the recording medium, while sliding along the playground shaped slanted member, can be guided to and smoothly piled on the medium stacking portion.

Further, according to the invention, a recording apparatus for the recording of a recording medium comprises this tray, and a liquid ejection apparatus for ejecting a liquid onto a target ejection medium comprises the tray. With this arrangement, a recording apparatus and a liquid ejection apparatus can be obtained that provide the operating effects described above.

DETAILED DESCRIPTION OF THE PREFERRED EMBODIMENTS

Figure 1:
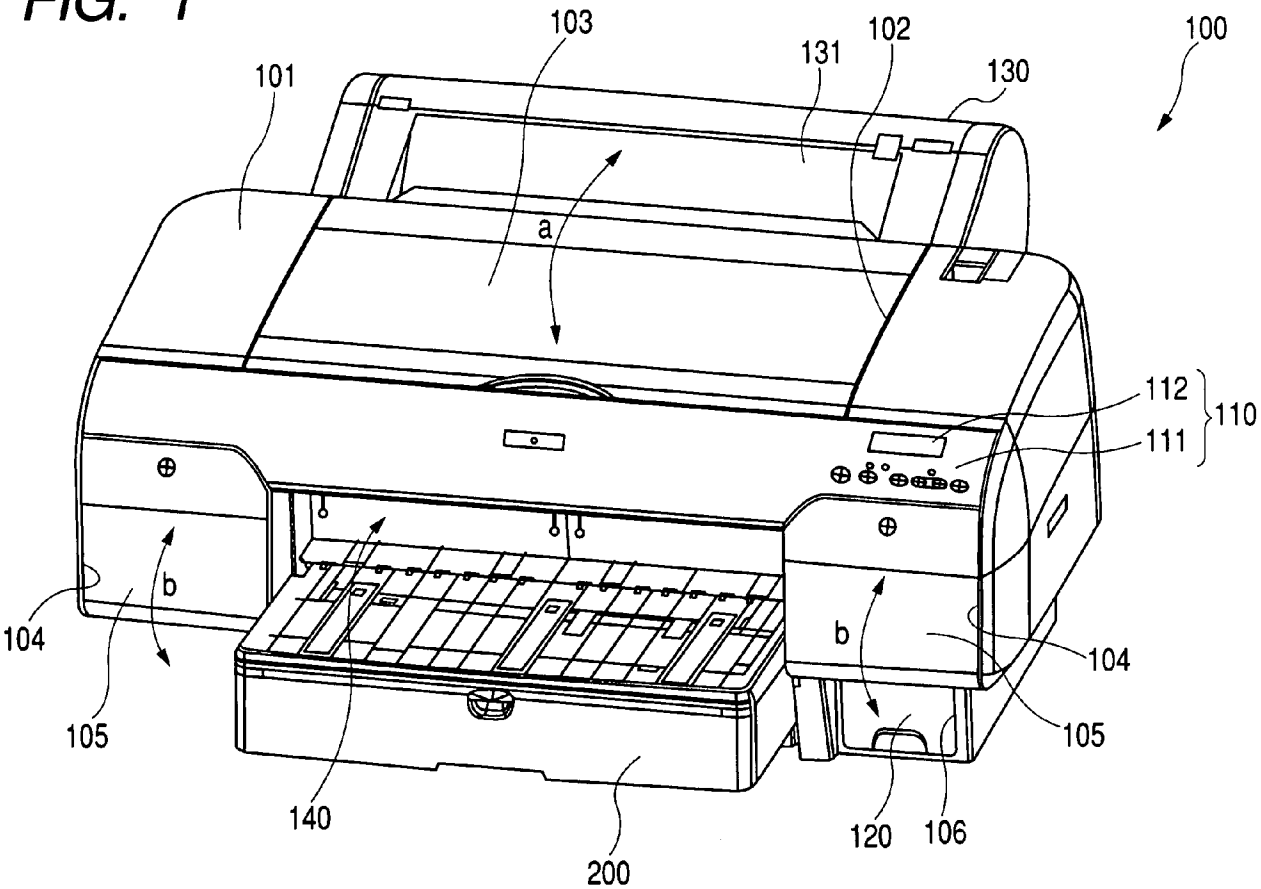
FIG. 1 is a perspective, oblique front view of the overall external appearance of an ink-jet printer that is a recording apparatus according to one embodiment of the present invention.

FIG. 1 is an oblique front perspective view of the overall external appearance of an ink-jet recording apparatus. An ink jet printer 100 is a large desktop printer that can print both cut-sheet paper, ranging in size from, for example, A4 to comparatively large sizes, such as A2, all of which conform to the JIS standards, and paper supplied as a roll. The ink-jet printer 100 is covered by a substantially rectangular parallelepiped cover 101 that, overall, is extended in the widthwise direction.

A rectangular window 102, formed in the upper face of the housing 101, is covered with a transparent or semi-transparent window cover 103, which is attached so as to be pivotable at a rotary shaft, located at an upper position, and in a direction indicated by a double-headed arrow a in FIG. 1. When the window cover 103 is raised by a user, opening the window 102, maintenance of the internal mechanism can be performed through the window 102.

Cartridge storage portions 104, wherein a plurality of cartridges can be inserted or removed, are formed on both sides at the front of the housing 101. Printing ink for individual colors is stored in the ink cartridges, and the ink cartridge storage portions 104 are covered with transparent or semi-transparent cartridge covers 105, so that they are attached to and are pivotable at rotary shafts, located at the lower positions, in directions indicated by double-headed arrows b in FIG. 1. Thus, when to unlock an engagement portion a user gently pushes a cartridge cover 105, and opens a cartridge storage portion 104, ink cartridges can be exchanged.

An operating portion 110, for entering instructions for printing operations, is provided above the cartridge storage portion 104 at the right front of the housing 101. The operating portion 110 includes buttons 111, such as a button for powering the ink-jet printer on or off, an operating button for instructing a paper search or the flushing of ink and a button for performing image processing, and a liquid crystal panel 112 for displaying the current state. A user can operate the buttons 111 and confirm their state while watching the liquid crystal panel 112.

A tank storage portion 106, into or from which a waste liquid tank 120 is inserted or removed, is formed below the cartridge storage portion 104 at the right front of the housing 101. During the cleaning of a recording head 162 (see FIG. 13), or while ink cartridges are being exchanged, waste ink is discharged and is stored in the waste liquid tank 120. Subsequently, to discard the waste ink, a user must merely remove the waste liquid tank 120.

A paper supply portion 130 for supplying paper rolls is located at the rear of the housing 101 and is extended upward, to the rear. A paper roll holder (not shown), for the loading of a single paper roll is arranged inside the paper supply portion 130, and a paper roll cover 131, for a pivoting type, is attached to the front face of the paper supply portion 130, where it will cover the paper roll holder (not shown). To set or remove the paper roll, the user need only raise the paper roll cover 131 and open the paper supply portion 130. The upper face of the paper roll cover 131 is a paper guide face along which a cut-sheet can be manually fed and guided.

A paper supply/discharge portion 140 is formed in the center of the front face of the housing 101, i.e., between the paired cartridge storage portions 104. A paper supply/discharge tray 200 on which cut-sheets, before or after printing, or paper provided as rolls is stacked is inserted into or removed from the paper discharge portion 140. The paper supply/discharge portion 140 is also designed so that when thick paper is manually fed it is not bent while being conveyed.

When the front portion of the paper supply/discharge tray 200 is inserted into the paper supply/discharge portion 140, the paper supply/discharge tray 200 is secured to the paper supply/discharge portion 140, while the rear portion being extended outside. The paper supply/discharge tray 200 is shaped like a cassette, so that cut sheets that are fed before printing are stacked inside the paper supply/discharge tray 200, and cut sheets that are discharged after printing, or paper supplied as a roll, are piled on the tray 200. A detailed description of the structure of the paper supply/discharge tray 200, which is the characteristic portion of this invention, will now be presented while referring to FIGS. 2 to 12.

Figure 2:
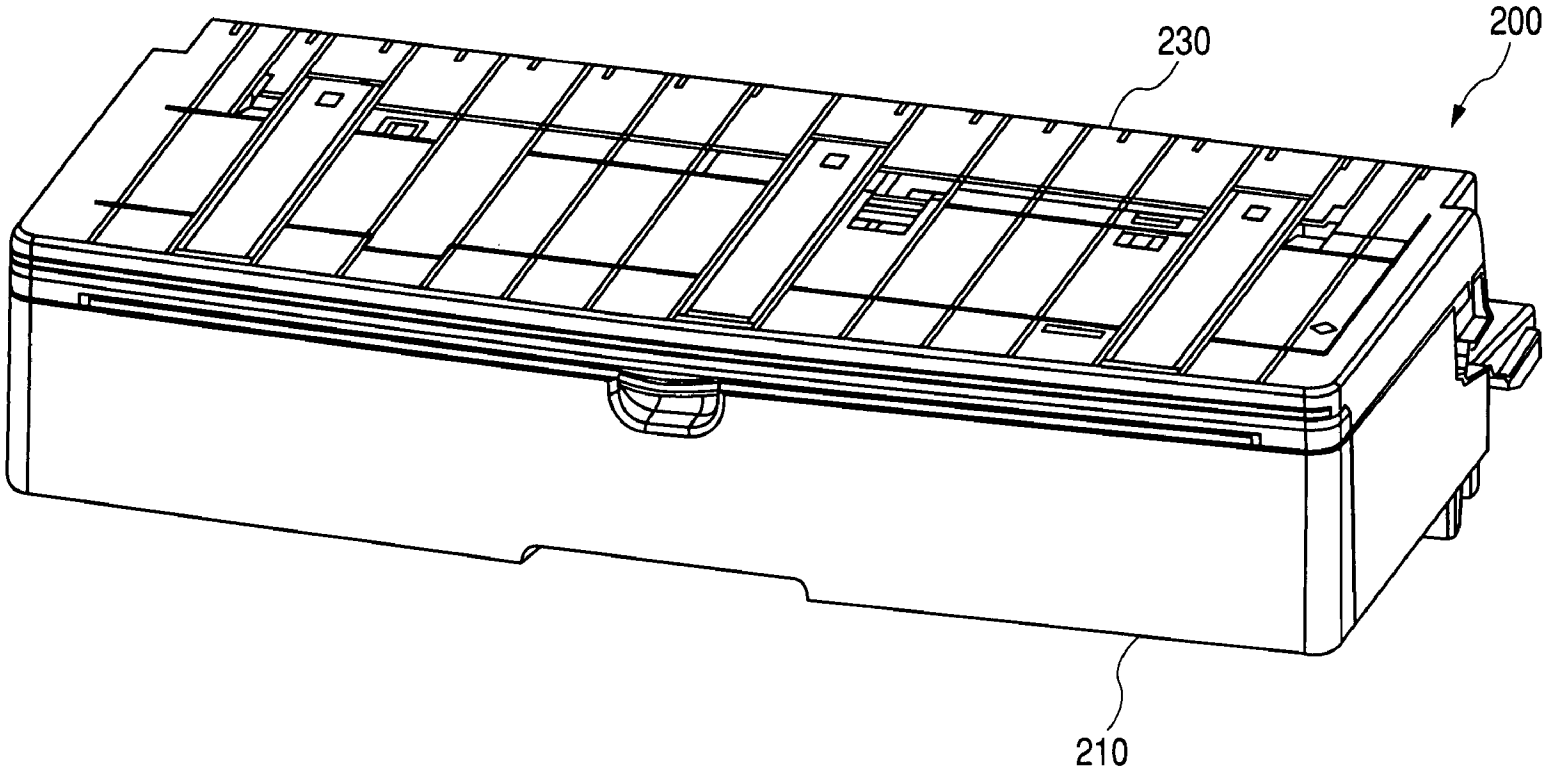
FIG. 2 is a perspective, oblique front view of the overall external appearance of a paper supply/discharge tray according to the embodiment of the invention.

FIG. 2 is an oblique front perspective view of the overall external appearance of the paper supply/discharge tray 200. The paper supply/discharge tray 200 includes a paper supply tray 210, which has a box-like shape, and a paper discharge tray 230, which has a lid-like shape and that covers the upper face of the paper supply tray 210. The paper supply/discharge tray 200 is formed so it is extendable or contractible in the paper supply/discharge direction, i.e., when the paper supply/discharge tray 200 is not being used, it can be compactly stored, while when the paper supply/discharge tray 200 is being used, it can cope with a variety of cut-sheet sizes.

Figure 3:
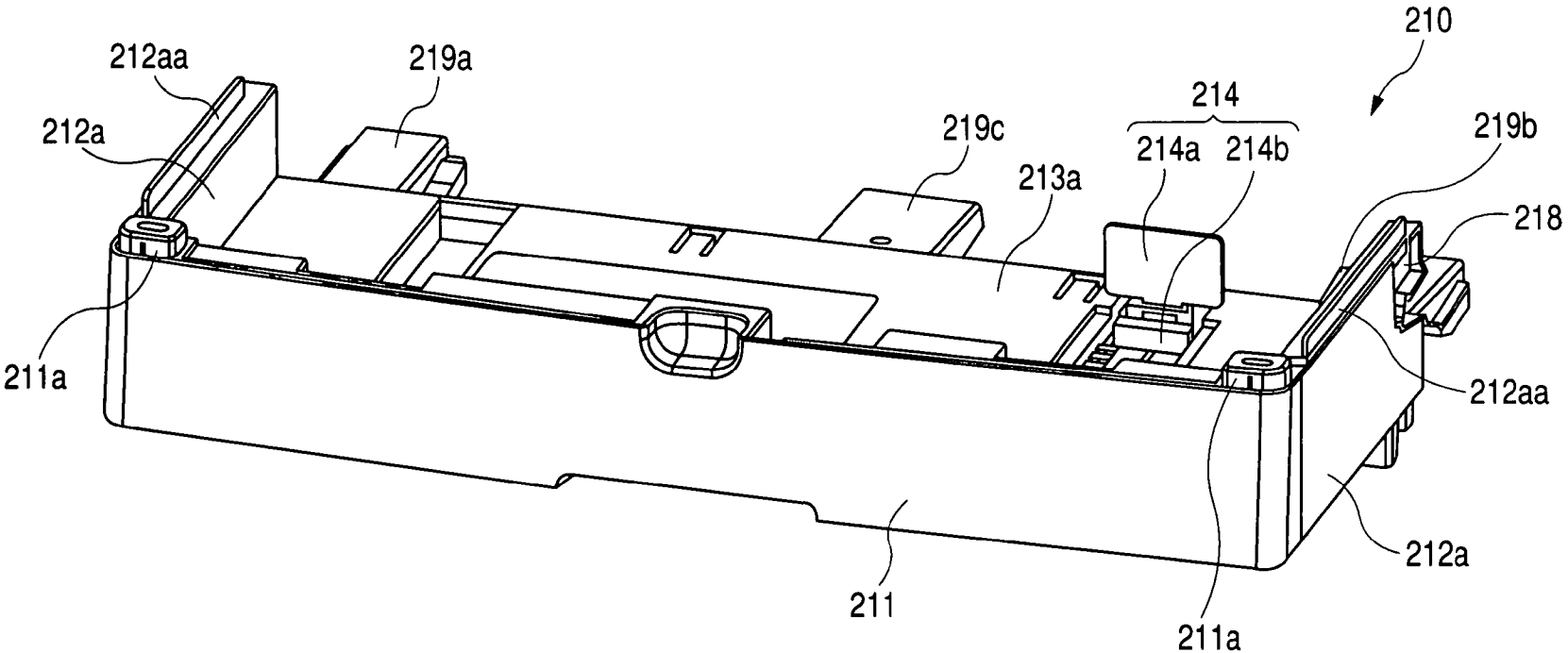
FIG. 3 is a perspective, oblique front view of the external appearance of a paper supply tray shown in FIG. 2.
Figure 4:
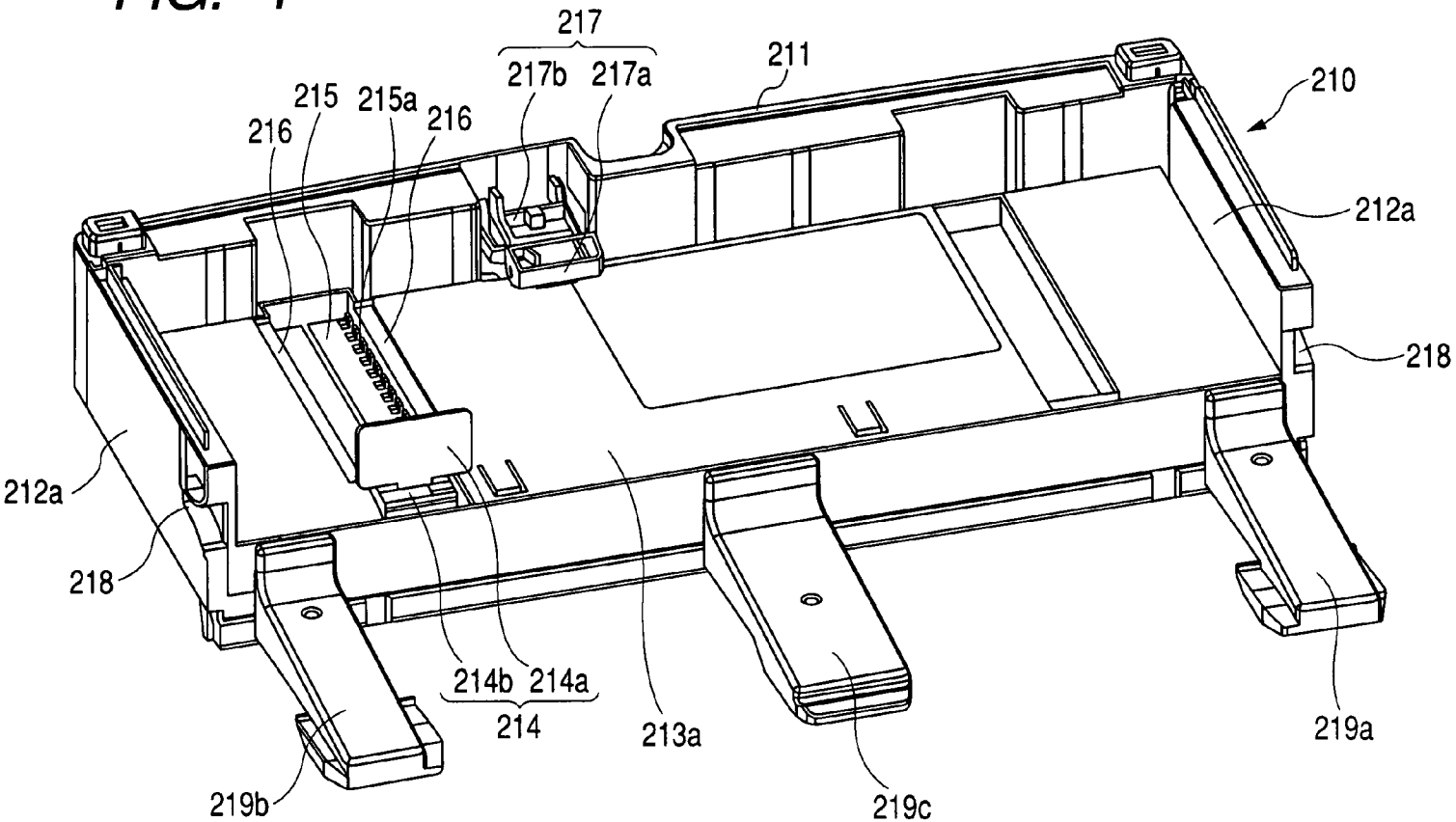
FIG. 4 is a perspective, oblique rear view of the external appearance of the paper supply tray in FIG. 2.

FIG. 3 is an oblique front perspective view of the overall external appearance of the supply tray 210. FIG. 4 is an oblique rear perspective view of the paper supply tray 210. The three sides of the paper supply tray 210 are enclosed by a front portion 211 and side portions 212*a*, and the rear portion of the paper supply portion 210 is open. That is, cut-sheets to be piled on a bottom portion 213*a* of the paper supply tray 213*a* are sequentially fed into the ink-jet printer from the rear of the paper supply tray 210.

A rear end guide 214 is arranged on the bottom portion 213*a* of the paper supply tray 210 in order to align the rear ends of sheets of the smallest sizes that can be used for the ink-jet printer 100 and that are stacked on the paper supply tray 210, i.e., the rear ends of the A4 paper sheets (hereinafter referred to as "A4 paper) that conform to the JIS standards. The rear end guide 214*a* includes a flat rectangular contact portion 214*a*, which abuts upon the rear ends of the A4 paper sheets, and a support portion 214*b*, which supports the contact portion 214*a*. The support portion 214*b* holds the contact portion 214*a*, so that the lower end of the contact portion 214*a* can pivotally move between the vertical state and the horizontal state.

A groove 215 is formed in the bottom portion 213*a* of the paper supply tray 210 in the paper feeding direction, and engagement portions 215*a* are formed, at constant intervals, in the groove 215. The support portion 214*b* is so arranged in the groove 215 that the support portion 214*b* can either freely slide along the groove 215 or can engage the engagement portions 215*b* and be positioned. Grooves 216 are formed in both walls of the groove 215, and when the contact portion 214*a* assumes a horizontal position, the contact portion 214*a* is stored along the grooves 216 so as to be on the same face as the bottom 213*a* of the paper supply tray 210.

With this arrangement, when A4 paper is employed, the support portion 214*b* is slid along the groove 215 to a position whereat the contact portion 214*a* does not interfere with the rear end of the A4 paper. Then, after the A4 paper has been mounted on the bottom portion 213*a* of the paper supply tray 210, the contact portion 214*a* is pivoted to the vertical state, the support portion 214*b* is moved along the groove 215, and the contact portion 214*a* is brought into contact with the rear end of the A4 paper. Then, after the rear ends have been aligned, the A4 paper sheets can be fed that are stacked on the bottom portion 213*a* of the paper supply tray 210.

When paper conforming to the JIS standards is larger than A4, i.e., when A3 or A2 paper conforming to the JIS standards (hereinafter referred to as A3 or A2 paper) is employed, the contact portion 214*a* is pivoted until it is horizontal and is fitted into the grooves 216 so as to be on the same plane as the bottom portion 213*a* of the paper supply tray 210. Then, the paper supply tray 210 is extended, and when A3 or A2 paper sheets are stacked on the bottom portion 213*a* of the paper supply tray 210, the length of the paper supply tray 210 is adjusted to accommodate the paper size, and the rear ends of the A3 or A2 sheets are brought into contact with the inner wall of the front portion 211 of the paper supply tray 210. As a result, the contact portion 214*a* does not interfere with the A3 or A2 paper that is stacked on the bottom portion 213*a* of the paper supply tray 210, and the sheets stacked on the bottom portion 213*a* of the paper supply tray 210 can be smoothly fed, with their rear ends aligned.

A rear end auxiliary roller 217 is provided for the front portion 211 of the paper supply tray 210 in order to prevent the overlapped feeding of the A3 or A2 paper sheets, the rear ends of which contact the inner wall of the front portion 211. The rear end auxiliary roller 217 includes a roller 217*a*, which rotates only in one direction, and an arm 217*b* for pivotally supporting the roller 217*a*. The roller 217*a* does not rotate in the paper feeding direction; it rotates only in the paper discharge direction.

One end of the roller 217*a* is supported by the arm 217*b*, while the other end is rotatably supported at the inner wall of the front portion 211. The arm 217*b* is formed with being extended inwardly the front portion 211 and upward the inner wall of the front portion 211, so that the roller 217*a* can be pivotally moved between the state wherein it contacts the bottom portion 213*a* of the paper supply tray 210 and the state wherein it is at rest above the front portion 211 of the paper supply tray 210.

With this structure, when A3 or A2 paper is to be fed, the roller 217*a* is pivoted by one end of the arm 217*b* being held until the roller 217*a* is positioned above the front portion 211 of the paper supply tray 210. When A3 or A2 paper is stacked on the paper supply tray 210, the roller 217*a* is pivoted by the end of the arm 217*b* being held until the roller 217*a* is positioned inside the front portion 211 of the paper supply tray 211 so that it contacts the surface of the rear end of the A3 or A2 paper.

When a paper feeding roller 142 (see FIG. 13) is rotated to feed the topmost A3 or A2 paper sheet, friction between the topmost A3 or A2 paper sheet and the second could pull the second A3 or A2 sheet so that, after a short delay, the two sheets are fed together. In this embodiment, since the roller 217*a* does not rotate in the paper feeding direction, friction occurs between the face of the roller 217*a* and the surface of the rear end of the A3 or A2 sheet. To avoid over lapped feeding, this friction between the face of the roller 217*a* and the surface of the rear ends of the A3 or A2 sheets need only be set so that it is smaller than the feeding force exerted by the paper feeding roller 142 and greater than the friction that occurs between the topmost and the second A3 or A2 paper sheets.

As a result, only the topmost A3 or A2 sheet is fed by the paper feeding roller 142, while the second A3 or A2 sheet is held by the roller 217*a*, which thereby prevents the overlapped feeding of the A3 or A2 paper. Further, since the roller 217*a* is rotated in the paper discharge direction, i.e., the direction opposite to the paper feeding direction, the second A3 or A2 sheet, which has been displaced slightly forwarded in the paper feeding direction, is pushed back by a separation member 143 in the direction opposite to the paper feeding direction, and is smoothly returned to its original position by the rotational force exerted by the roller 217*a*.

Pin engagement portions 218 are formed like grooves in the rear portions along the side walls 212*a* of the paper supply tray 210 to position the paper supply tray 210 at the paper supply/discharge portion 140. In addition, base portions 219*a*, 219*b* and 219*c* are integrally formed with the rear portion of the paper supply tray 210 to secure the paper supply tray 210 to the paper supply/discharge portion 140. These base portions 219*a*, 219*b* and 219*c* are projected outward from three locations on the paper supply tray 210, i.e., at both ends and in the center.

Figure 5A:
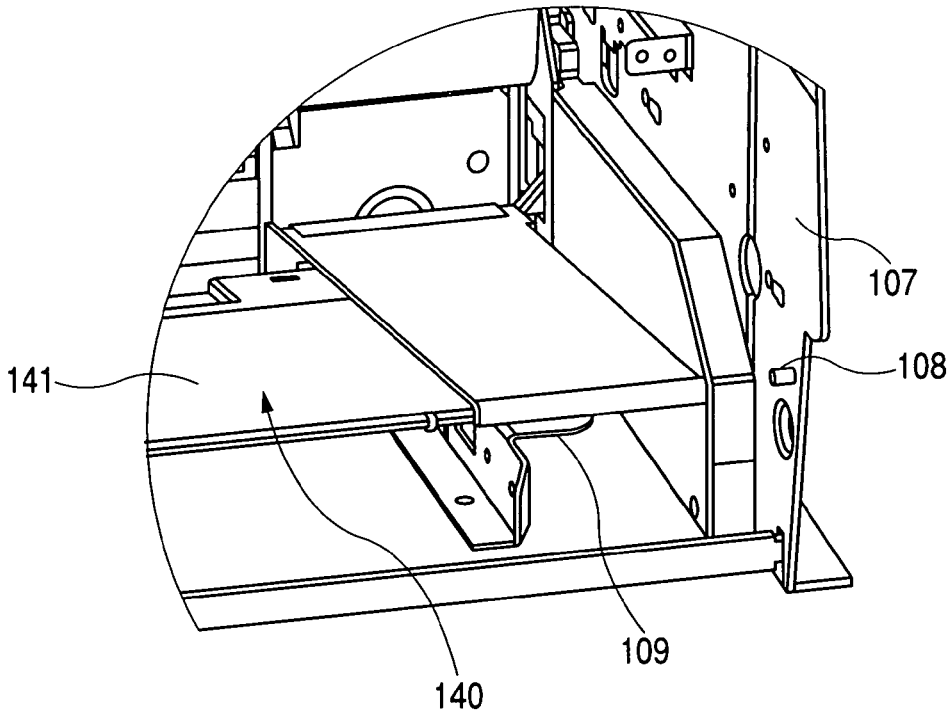
FIGS. 5A and 5B are detailed perspective views of both ends of the paper supply/discharge portion of the ink-jet printer in FIG. 1.
Figure 5B:
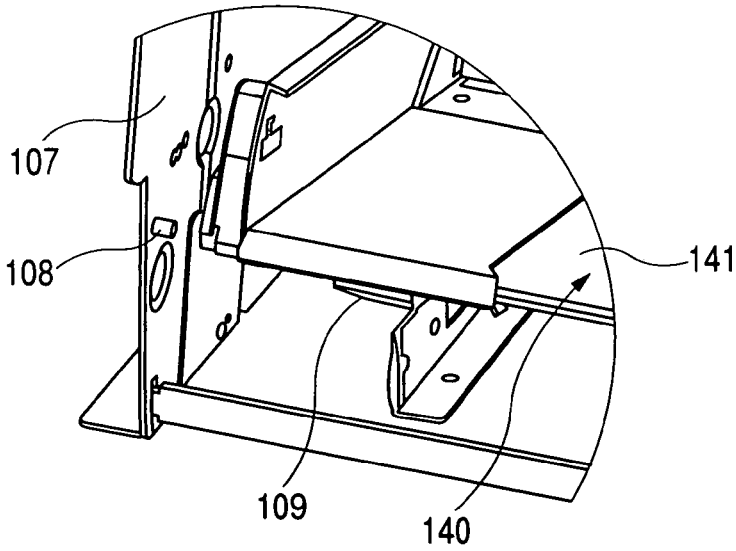

FIGS. 5A and 5B are detailed perspective views of both ends of the paper supply/discharge portion 140. Pins 108 are formed on the inner walls of side frames 107 of the paper supply/discharge portion 140. To attach the paper supply tray 210 to the paper supply/discharge portion 140, the pins 108 are inserted into the pin engagement portions 218 of the paper supply tray 210 and hold the paper supply tray 210 in position. Furthermore, a hopper 141 is arranged in the paper supply/discharge portion 140. When the paper supply tray 210 is mounted, the hopper 141 is on the same plane as the bottom portion 213*a* of the paper supply tray 210, and when cut-sheets stacked in the paper supply tray 210 are to be fed, the hopper 141 raises the leading edge of each sheet and brings it into contact with the paper feeding roller 142.

Metal engagement portions 109, which are substantially L shaped, are located under both ends of the hopper 141. When the paper supply tray 210 is to be attached, the distal ends of the base portions 219*a* and 219*b*, located on both ends at the rear portion of the paper supply tray 210, are fitted into the engagement portions 109 to securely support the paper supply tray 210. As the paper supply tray 210 is loaded into the paper supply/discharge portion 140, the pins 108 arranged inside the side frames 107 are inserted into the pin engagement portions 218 of the paper supply tray 210 and hold the paper supply tray 210 in position.

When the paper supply tray 210 is loaded into the paper supply/discharge portion 140, the distal ends of the base portions 219*a* and 219*b*, which are formed at both ends of the rear portion of the paper supply tray 210, are fitted into the engagement portions 109 located under the hopper 141, and the upper faces of the base portions 219*a* and 219*b* contact the rear face of the hopper 141 and securely support the paper supply tray 210. Furthermore, when the paper supply tray 210 is loaded into the paper supply/discharge portion 140, the base portion 219*c*, which is formed in the center of the paper supply tray 210, is brought into contact with the reverse face of the hopper 141 and securely holds the paper supply tray 210.

If the paper supply tray 210 were positioned by using only the pins 108, because of the weight of cut sheets that are stacked in the paper supply tray 210, the paper supply/discharge tray 200 would wobble from side to side and either the hopper 141 would be bent or the portions whereby the paper supply tray 210 is attached to the paper supply/discharge portion 140 would be broken, so that the feeding of paper would be adversely affected. However, as is described above, the paper supply/discharge tray 200 can be securely held by not only the pins 108 provided at two locations, but also by the engagement portions 109 that are provided at two location and the base portions 219*a*, 219*b* and 219*c* that are arranged at three location. Therefore, a phenomenon wherein, because of the weight of cut sheets stacked in the paper supply tray 210, the paper supply/discharge tray 200 wobbles from side to side and either the hopper 141 is bent or the attached portions are damaged can be prevented, and the highly accurate feeding of paper can be maintained.

Figure 6:
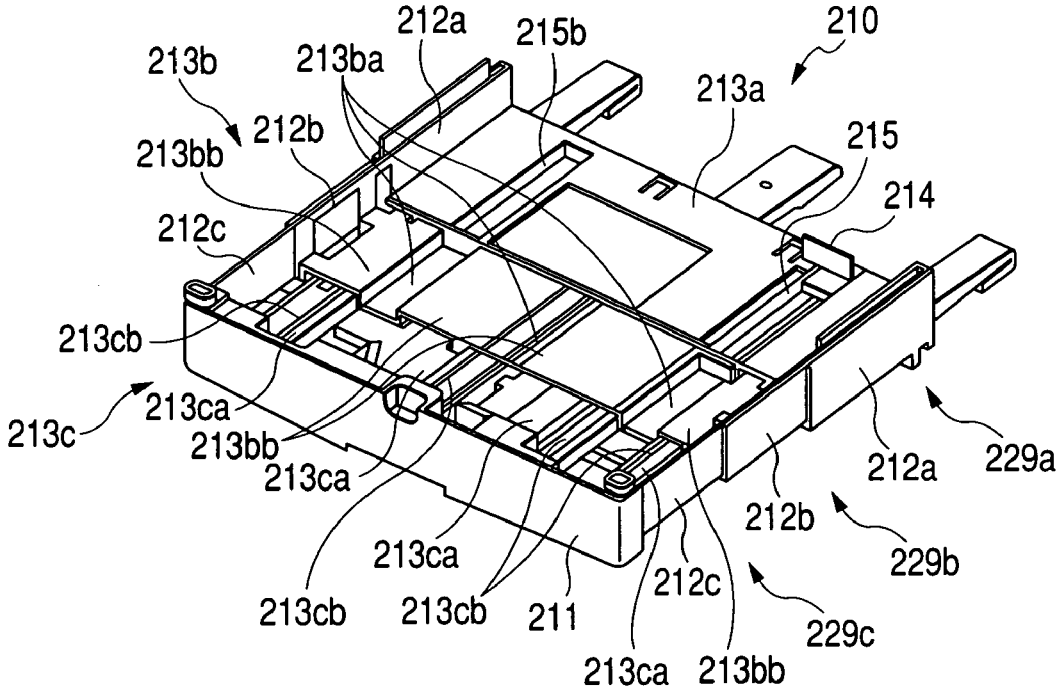
FIG. 6 is a perspective view of the obverse side when the paper supply tray in FIG. 3 is extended.

Since, as is described above, the paper supply tray 210 is contractible or extendable in the paper supply/discharge direction, the paper supply tray 210 can be compactly stored when not in use, or can be adjusted so that it can cope with cut-sheets of various sizes. Specifically, as is shown in FIG. 6, the paper supply tray 210 includes: a first feeding member 229*a*, which is formed by the side walls 212*a* and the bottom portion 213*a;* a second feeding member 229*b*, which is formed by side walls 212*b* and a bottom portion 213*b* and can be retracted into or extended outward from the first feeding member 229*a;* and a third feeding member 229*c*, which is formed by side walls 212*c*, a bottom portion 213*c* and the front portion 211 and can be retracted into or extended outward from the second feeding member 229*b*.

Figure 7:
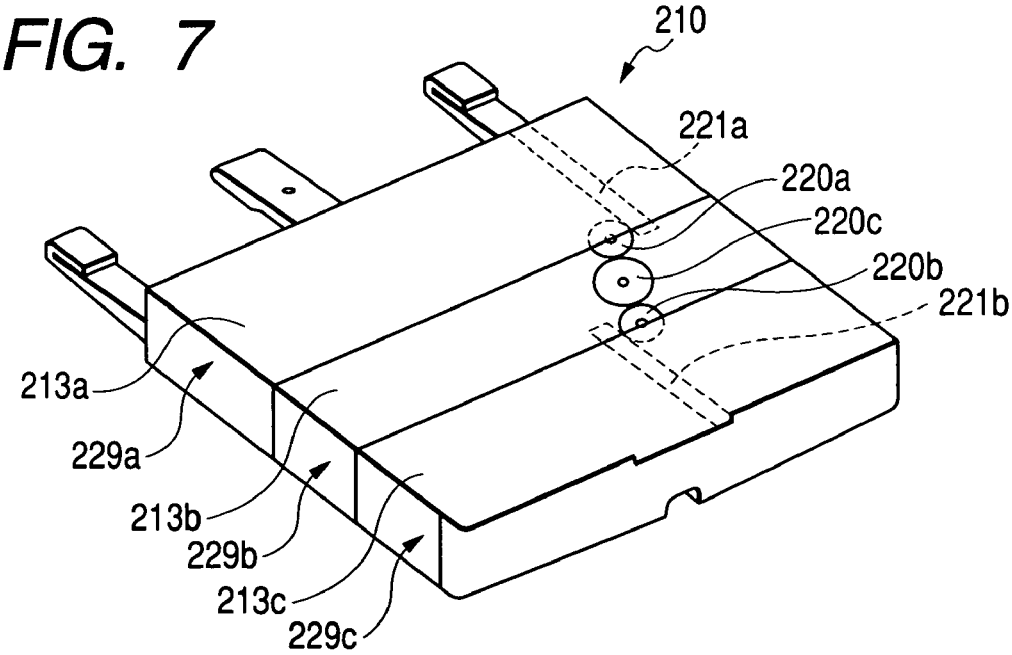
FIG. 7 is a perspective view of the reverse side when the paper supply tray in FIG. 3 is extended.

As is shown in FIG. 7, to contract or extend the paper supply tray 210, the feeding members 229*a*, 229*b* and 229*c* are synchronously operated by a gear mechanism provided on the reverse face of the paper supply tray 210. This gear mechanism includes: a series of three pinion gears 220*a*, 220*b* and 220*c*, which are arranged on the reverse face of the bottom portion 213*b* of the second feeding member 229*b* and for which, at the least, the same formation is employed on both sides; a rack gear 221*a*, which is formed on the reverse face of the bottom portion 213*a* of the first feeding member 229*a* and which engages the gear 220*a* located on one side; and a rack gear 221*b*, which is formed on the reverse face of the bottom portion 213*c* of the third feeding member 229*c* and which engages the gear 220*b* located on the other side.

For example, when a user pulls out the third feeding member 229*c*, while holding the front portion 211 of the paper supply tray 210 that is loaded into the paper supply/discharge portion 140, the rack gear 221*b*, which is arranged on the reverse face of the bottom portion 213*c* of the third feeding member 229*c*, is moved forward and the pinion gear 220*b*, arranged on the reverse face of the bottom portion 213*b* of the second feeding member 229*b*, is rotated forward.

At the same time, the pinion gear 220*c*, arranged on the reverse face of the bottom portion 213*b* of the second feeding member 229*b*, is rotated in reverse, and the pinion gear 220*a* is rotated forward along the rack gear 221*a* that is located on the reverse face of the bottom portion 213*a* of the first feeding member 229*a*. Therefore, together with the third feeding member 229*c*, the second feeding member 229*b* is pulled forward the same distance.

When, for example, a user pushes on the third feeding member 229*c* while holding the front portion 211 of the paper supply tray 210 that is loaded into the paper supply/discharge portion 140, the rack gear 221*b*, arranged on the reverse face of the bottom portion 213*c* of the third feeding member 229*c*, is moved backward, and the pinion gear 220*b*, arranged on the reverse face of the bottom portion 213*b* of the second feeding member 229*b*, is rotated in reverse.

At the same time, the pinion gear 220*c*, arranged on the reverse face of the bottom portion 213*b* of the second feeding member 229*b*, is moved forward, and the pinion gear 220*a* is rotated in reverse along the rack gear 221*a* that is provided on the reverse face of the bottom portion 213*a* of the first feeding member 229*a*. Therefore, together with the third feeding member 229*c*, the second feeding member 229*b* is pushed backward the same distance.

The side walls 212*a* of the first feeding member 229*a* and the side walls 212*b* of the second feeding member 229*b* are hollow. With this structure, the side walls 212*c* of the third feeding member 229*c* are inserted into or extracted from the hollow portions of the side walls 212*b* of the second feeding member 229*b*, and the side walls 212*b* of the second feeding member 229*b* are inserted into or extracted from the hollow portions of the side walls 212*a* of the first feeding member 229*a*.

In addition to the groove 215 along which, as is described above, the rear end guide 214 is slid, a dummy groove 215*b* is formed at the symmetrical location for the groove 215 in the bottom portion 213*a* of the first feeding member 229*a* in order to take a weight balance. Since the third feeding member 229*c* is stored in the second feeding member 229*b*, and the second feeding member 229*b* is stored in the first feeding member 229*a*, the two members 229*c* and 229*b* are formed thinner than the first feeding member 229*a*, so that the rigidity of these members 229*c* and 229*b* tends to be reduced.

Therefore, the bottom portion 213*b* of the second feeding member 229*b* is formed of multiple raised and recessed portions, i.e., three recessed portions 213*ba* and four raised portions 213*bb*, so that the second feeding member 229*b* can be stored in the first feeding member 229*a*, avoiding the grooves 215 and 215*b*, and the rigidity of the second feeding member 229 is increased. Further, the bottom portion 213*c* of the third feeding member 229*c* is formed of four separate blocks 213*ca* that correspond to the four raised portions 213*bb* of the bottom portion 213*b* of the second feeding member 229*b*.

Since the bottom portion 213*c* of the third feeding member 229*c* is constituted by the four separate blocks 213*ca*, some transverse play tends to occur in the third feeding member 229 when it is inserted into or extracted from the four raised portions 213*bb* of the bottom portion 213*b* of the second feeding member 229*b*. Therefore, guidance grooves 213*cb*, extended in the paper supply/discharge direction, are formed in the blocks 213*ca* to support the insertion and extraction of the third feeding member 229*c* along guide rails (not shown) that are formed on the raised portions 213*bb* and extended in the paper supply/discharge direction. With this structure, when the blocks 213*ca* of the bottom portion 213*c* of the third feeding member 229*c* are inserted into or extracted from the raised portions 213*bb* of the bottom portion 213*b* of the second feeding member 229*b*, the occurrence of transverse play can be avoided, and the paper supply tray 210 can be smoothly extended or retracted in the paper supply/discharge direction.

Figure 8:
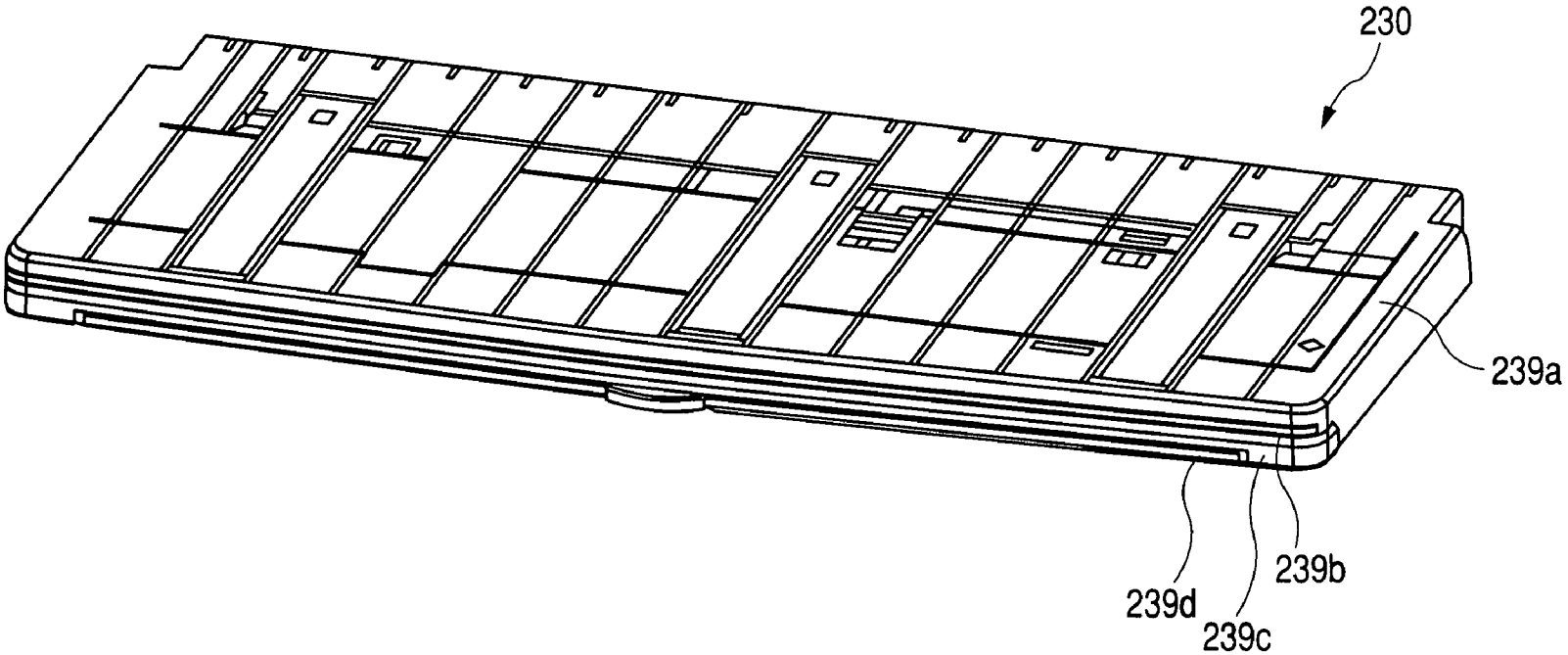
FIG. 8 is a perspective, oblique front view of the external appearance of a discharge tray in FIG. 2.
Figure 9:
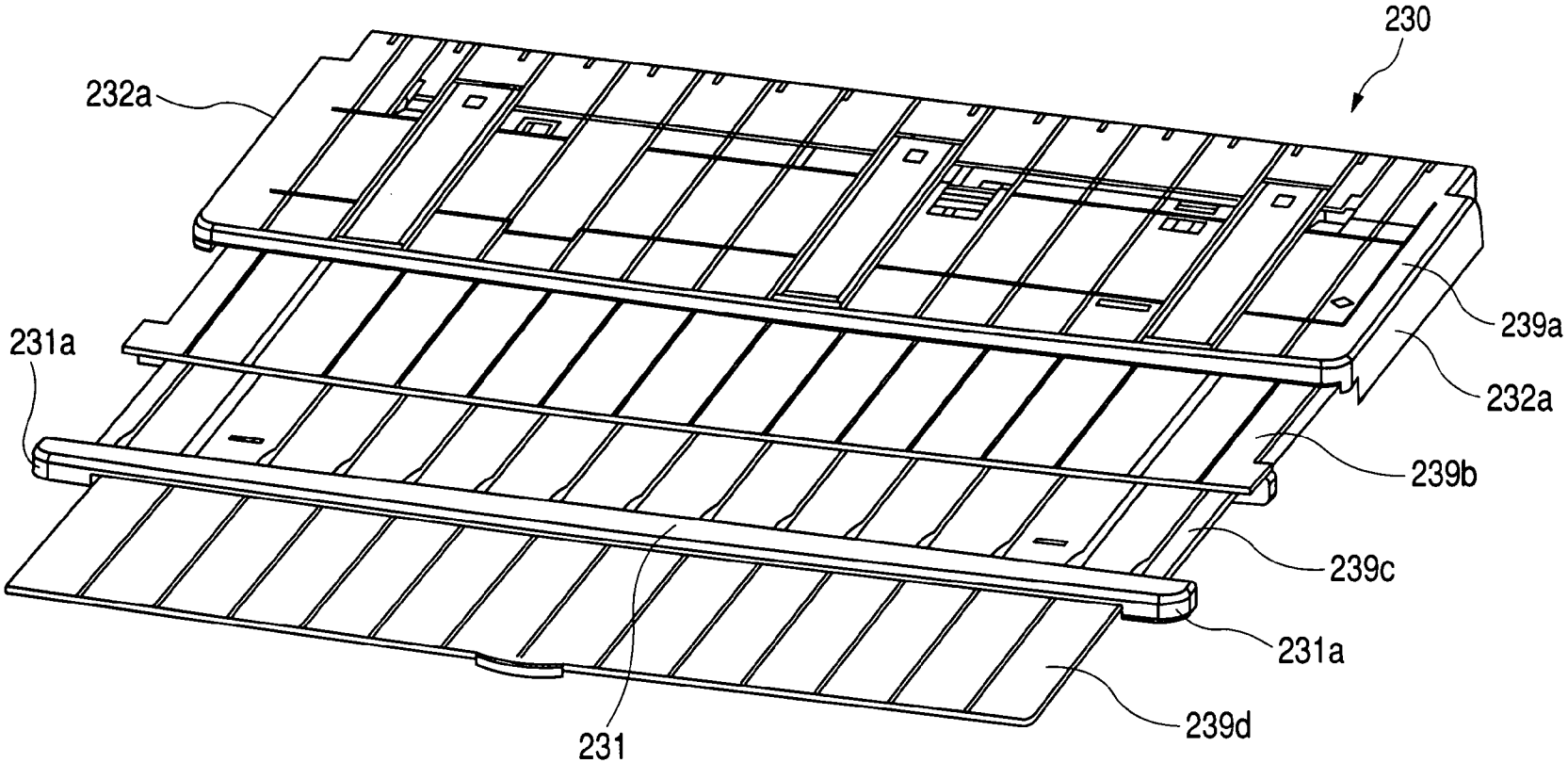
FIG. 9 is a perspective view of the obverse side when the paper supply tray in FIG. 8 is extended.

FIGS. 8 and 9 are perspective, oblique front views of the overall external appearance of the discharge tray 230. As well as the paper supply tray 210, the discharge tray 230 can be is extended or retracted in the paper supply/discharge direction. When the discharge tray 230 is not in use, it can be compactly stored, as is shown in FIG. 8, or when it is in use, it can be adjusted to cope with cut-sheets of various sizes, as is shown in FIG. 9.

Specifically, the discharge tray 230 is constituted by four stages, i.e., it includes: a first discharge member 239*a*, which is formed so it is large enough to cover the upper, open face of the first feeding member 229*a* of the paper supply tray 210 shown in FIG. 6; a second discharge member 239*b*, which is formed so it is large enough to cover the upper, open face of the second feeding member 229*b* of the paper supply tray 210; a third discharge member 239*c*, which is formed so it is large enough to cover the upper, open face of the third feeding member 229*c* of the paper supply tray 210; and a fourth discharge member 239*d*, which is formed so it is slightly smaller than the third discharge member 231*c*.

The fourth discharge member 239*d* is retractable and extendable relative to the recessed portion in the reverse face of the third discharge member 239*c;* the third discharge member 239*c* is retractable and extendable relative to the recessed portion in the reverse face of the second discharge member 239*b;* and the second discharge member 239*b* is retractable and extendable relative to the recessed portion in the reverse face of the first discharge member 239*a*. That is, as is shown in FIG. 8, the discharge members 239*a*, 239*b*, 239*c* and 239*d* are laminated when they are stored.

Side faces 232*a* of the first discharge member 239*a* are shaped so that they can be held while covering rails 212*aa* that project upward from the tops of the side walls 212*a* of the first feeding member 229*a* of the paper supply tray 210 shown in FIG. 3. Side faces 231*a* of a front portion 231 of the third discharge member 239*c* are shaped so that they can be held while covering bosses 211*a* that project upward at both ends of the front portion 211 of the paper supply tray 210 shown in FIG. 3.

With this arrangement, when, as is shown in FIG. 2, the contracted paper supply tray 210, on which the contracted discharge tray 230 is placed, is attached to the paper supply/discharge portion 140, and when the user pulls out the third feeding member 229*c* by holding the front portion 211 of the paper supply tray 210, the pinion gears 220*a*, 220*b* and 220*c* and the rack gears 221*a* and 221*b* interlock with each other, and the second feeding member 229*b* is extracted forward the same distance as the third feeding member 229*c*, while the first feeding member 229*a* is not moved.

At this time, the side portions 232*a* of the first discharge member 239*a* of the discharge tray 230 engage the rails 212*aa* that are projected upward at the tops of the side walls 212*a* of the first feeding member 229*a* of the paper supply tray 210, and the two ends 231*a* of the front portion 231 of the third discharge member 239*c* of the discharge tray 230 engage the bosses 211*a* that are projected upward from both ends of the front portion 211 of the paper supply tray 210.

Therefore, while the first discharge member 239 is at rest with the first feeding member 229*a*, the second discharge member 239*b* is extracted the same distance as the second feeding member 229*b*, and the third discharge member 239*c* is also extracted the same distance as the third feeding member 229*c*. When the fourth discharge member 239*d* has been extracted, the final setup style can be obtained.

Figure 10:
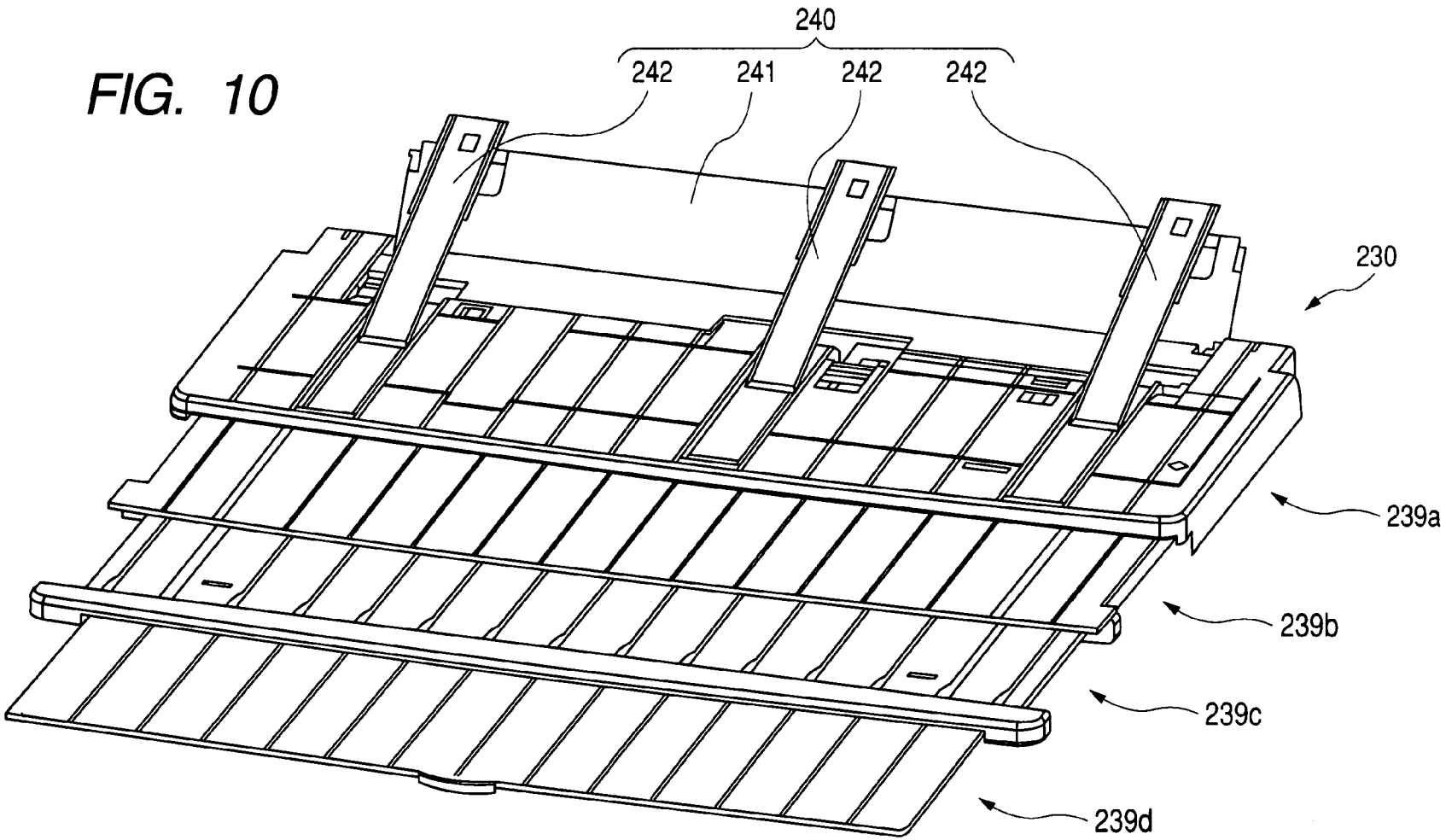
FIG. 10 is a perspective view of another form of the paper supply tray in FIG. 9.

As is shown in FIG. 10, a paper roll guide portion 240 is provided on the upper face of the first discharge member 239*a* to smoothly stack paper roll sheets as they are discharged. The paper roll guide portion 240 includes a first guide plate 241 having in a rectangular shape and three strip shaped guidance plates 242. The length of the long sides of the first guidance plate 241 is substantially equal to the width of the first discharge member 239*a*, while the length of the short sides is substantially half the depth of the first discharge member 239*a*. Both ends of one long side of the first guidance plate 241 are pivotally attached to the rear end of the first discharge member 239*a*, while the second guidance plates 242 are pivotally attached, at one longitudinal end, to the respective ends and the center of the other long side of the first guidance plate 241.

Figure 11:
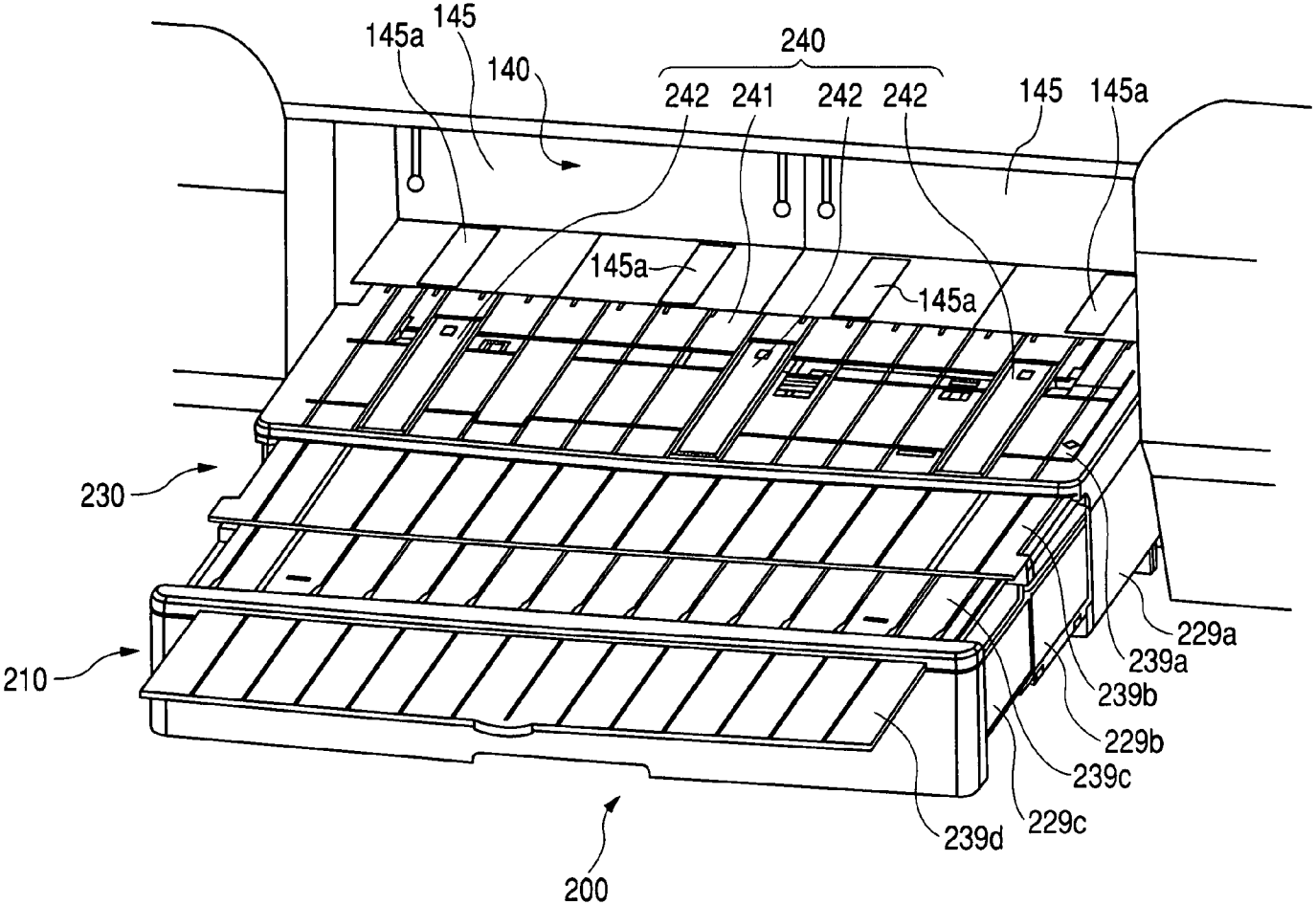
FIG. 11 is a perspective view of the use state of the paper supply/discharge tray in FIG. 2.
Figure 12:
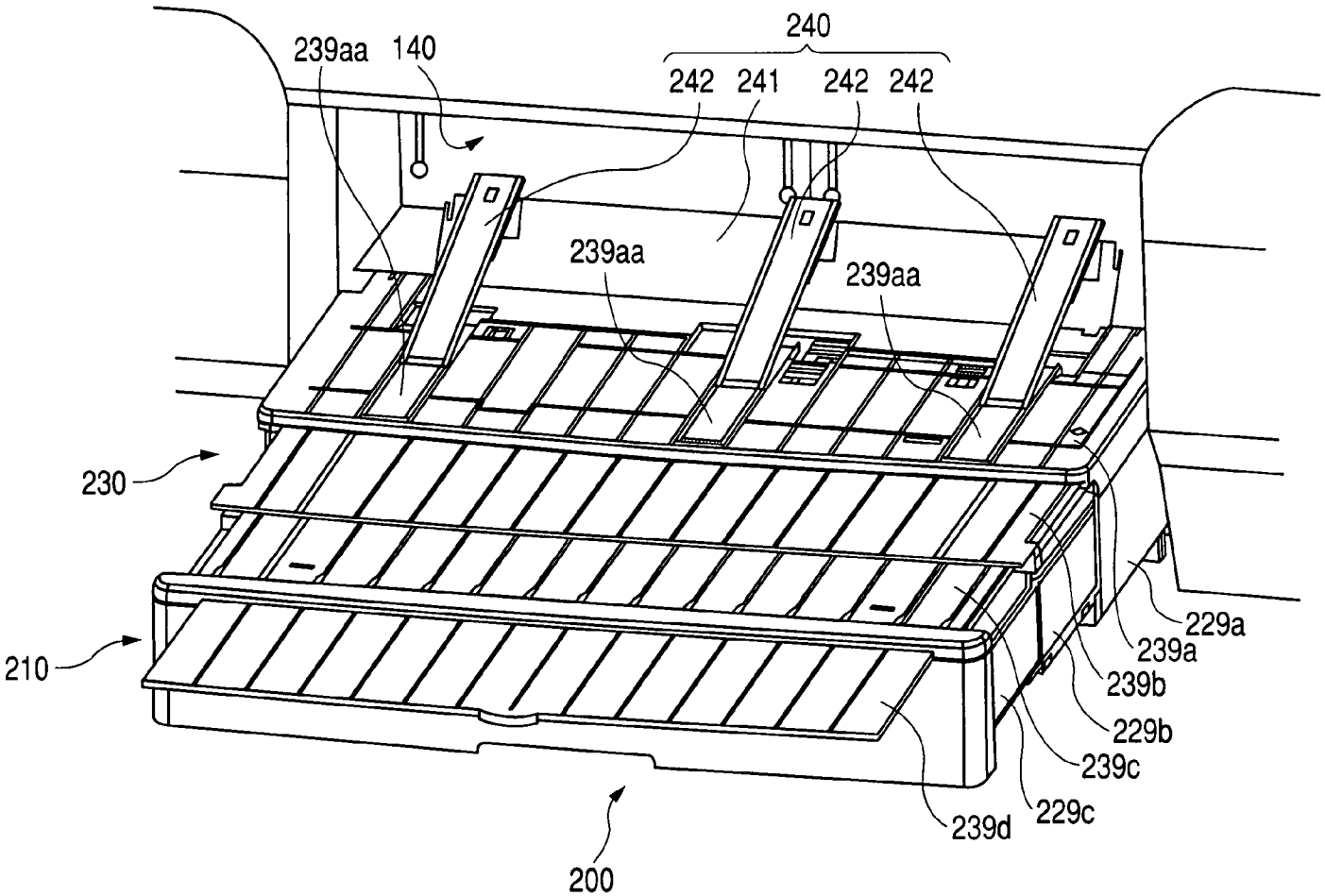
FIG. 12 is a perspective view of another use state of the paper supply/discharge tray in FIG. 2.

FIGS. 11 and 12 are perspective views of the paper supply/discharge portion 140 for mounting the paper supply/discharge tray 200. When cut-sheets are to be stacked, as is shown in FIG. 11, the paper roll guidance plate 240 is stored in the upper face of the first discharge member 239*a*, i.e., the upper face of the first discharge member 239*a* is flat. In this state, a cut sheet that has been discharged by a discharge roller 155 (see FIG. 13) is smoothly accepted and stacked on the discharged paper receiving face, formed by the side walls and the bottom face of a guide portion 145, which is L shaped in cross section, and the upper faces of the discharge members 239*a* to 239*d*.

A sponge mat 145*a* is adhered to the bottom face of the guide portion 145. When a second sheet is discharged, after the first cut sheet has been stacked, the sponge mat 145 serves as a stopper to prevent the leading edge of the second cut sheet from striking the first cut sheet and causing it to drop off the discharged paper receiving face.

When roll paper sheets are to be stacked, as is shown in FIG. 12, a user hooks with a finger one long side of the first guidance plate 241 of the paper roll guide portion 240, which is provided on the upper face of the first discharge member 239*a*, and rotates the first guidance plate 241 to the rear. This raises the longitudinal ends of the second guidance plates 242 that are attached to the first guidance plate 241, while the other longitudinal ends are slid to the rear along the grooves 239*aa* that are formed in the upper face of the first discharge member 239*a*. The pivoting of the first guidance plate 241 is continued until an acute angle is described by the first guidance plate 241 and the second guidance plates 242.

As a result, on one side, the longitudinal ends of the second guidance plates 242 approach the top portions of the side walls of the guide portion 240, and the second guidance plates 242 are positioned so they will act like slides. Therefore, when a curled roll paper sheet is discharged by the discharge roller 155, the leading edge of the paper is not caught by the guide portion 240, but is slid along the second guidance plates 242, which are shaped like a slide, and is guided to the upper faces of the discharge members 239*a* to 239*d*. Therefore, the roll paper sheets can be smoothly stacked on the discharged paper receiving face formed by the second guidance plates 242 and the upper faces of the discharge members 239*a* to 239*d*.

Figure 13:
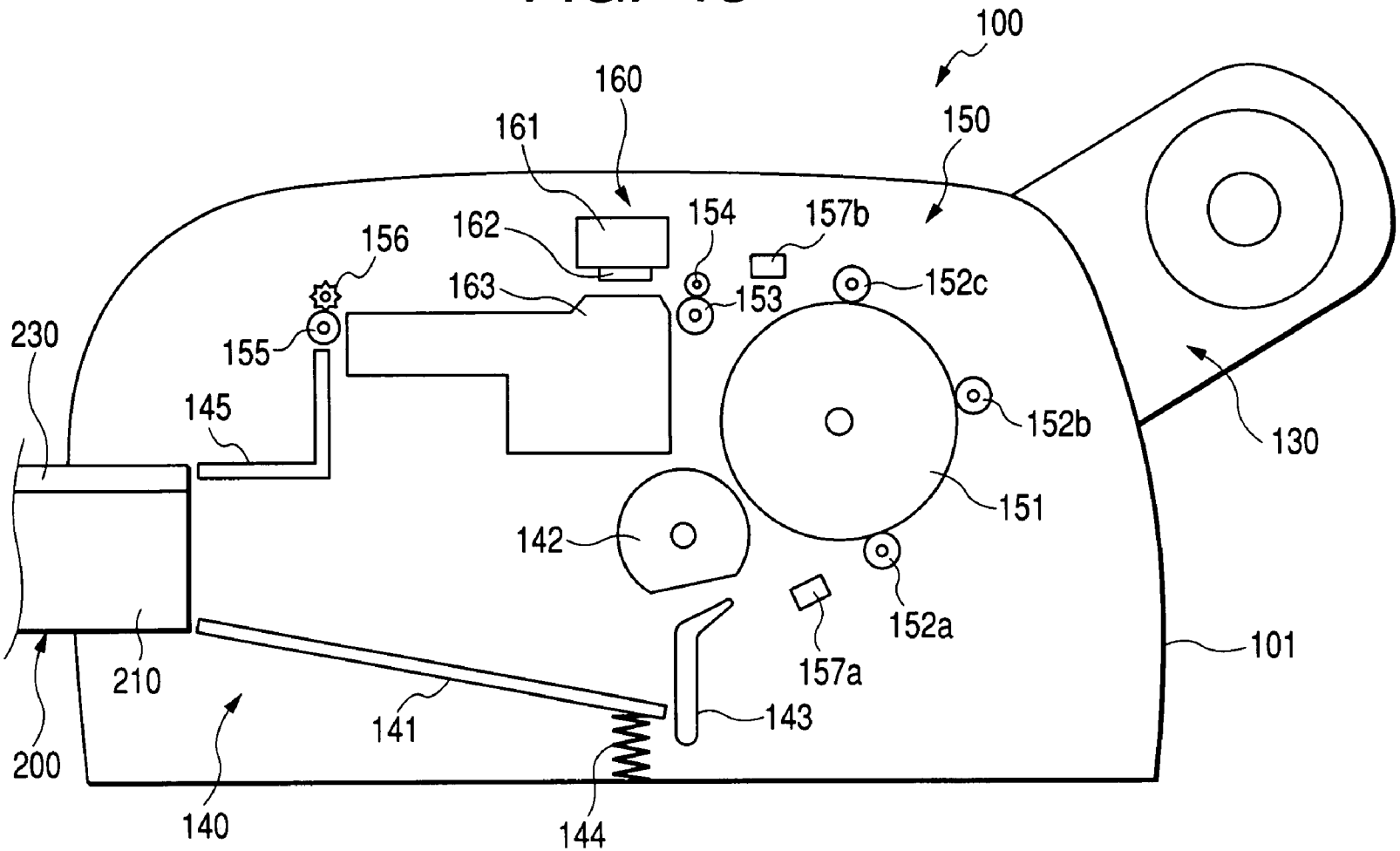
FIG. 13 is a schematic cross-sectional side view of the internal structure of the ink-jet printer in FIG. 1.

FIG. 13 is a schematic, cross-sectional side view of the internal arrangement of the ink-jet printer shown in FIG. 1. The paper supply/discharge portion 140, a conveying portion 150 and a recording portion 160 are arranged in the housing 101. The paper supply/discharge portion 140 includes the hopper 141, the paper feeding roller 142 and the separation member 143 for feeding cut-sheets. The hopper 141 is a flat plate, on top of which cut-sheets can be stacked. One end of the hopper 141 is located near the paper feeding roller 142 and the separation member 143, while the other end is located near the bottom face of the paper supply tray 210 of the paper supply/discharge tray 200 that is attached. One end of a compression spring 144 is attached to the bottom face of the housing 101, while the upper end is attached to the reverse face at one end of the hopper 141, so that as the compression spring 144 is compressed, or expands, the hopper 141 pivots at the end opposite that to which the compression spring 144 is attached.

The paper feeding roller 142 is partially cut away, so that it is D shaped in cross section, and is rotated intermittently to convey, using friction, a cut-sheet that is on the hopper 141. The separation member 143 has a rough upper face, and when cut-sheets are overlapped and fed by the paper feeding roller 142, friction produced by the separation member 143 separates the lower cut-sheet from the upper cut-sheet. The relationship between a cut-sheet that is mounted on the hopper 141 and the paper feeding roller 142 will now be described while referring to FIGS. 14A and 14B.

Figure 14A:
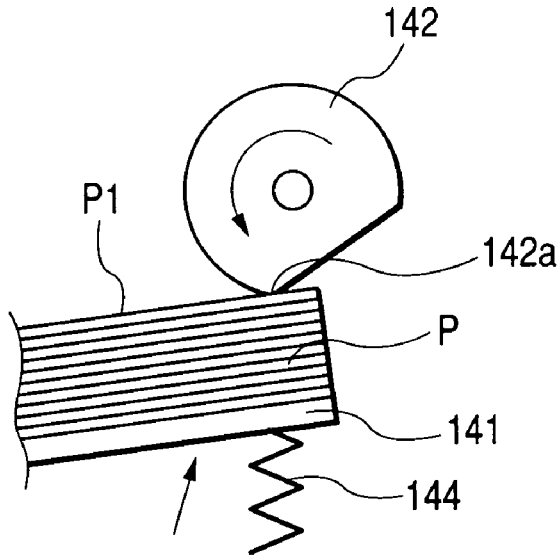
FIGS. 14A and 14B are diagrams showing the state wherein paper on a hopper contacts a paper feeding roller.
Figure 14B:
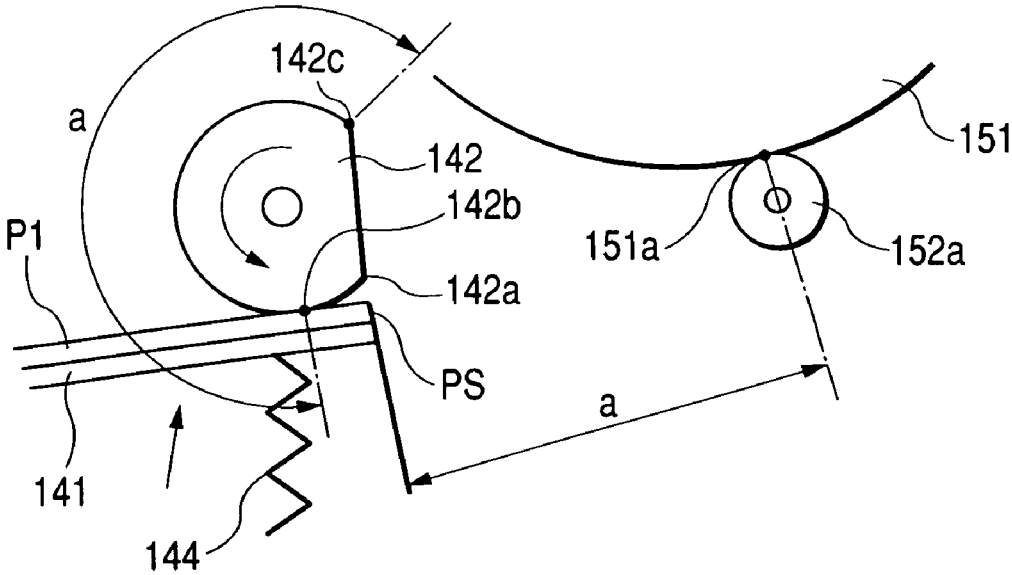

FIGS. 14A and 14B are diagrams showing the state wherein the paper feeding roller 142 contacts cut-sheets P mounted on the hopper 141. In FIG. 14A, the largest number of cut-sheets P are stacked on the hopper 141. The relationship in this case is adjusted, so that when the hopper 141 is raised, the cut-away portion of the paper feeding roller 142 does not contact a topmost cut-sheet P1, and its outer circumference contacts the topmost cut-sheet P1 only after an arc start point 142*a* is passed.

In FIG. 14B, the smallest number of cut sheets, i.e., one cut-sheet P1, is mounted on the hopper 141. The relationship in this case is so adjusted that when the hopper 141 is raised, the cut-sheet P1 is contacted, as the paper feeding roller 142 is rotated, at a contact point 142*b* slightly after the arc start point 142. At the contact point 142*b*, the circumferential length a to an arc end point 142*c* is equal to the interval from a leading edge PS of the sheet P1 to a contact point 151*a* between a sub-roller 151 and a coupled roller 152*a*.

Since the relationship between the cut-sheet and the paper feeding roller 142 is adjusted as described above, when the number of cut-sheets P prepared on the hopper 141 is smaller than the maximum number, the topmost cut-sheet P1 is not released by the paper feeding roller 142 until the leading edge PS reaches the contact point 151*a* between the sub-roller 151 and the coupled roller 152*a*. Therefore, the cut-sheet P1 can be correctly conveyed to the sub-roller 151, and feeding errors can be eliminated.

The conveying portion 150 includes: the sub-roller 151 and the coupled rollers 152*a*, 152*b* and 152*c*, a feeding roller 153 and a coupled roller 154, the discharge roller 155, and a serrated roller 156, all of which are used to convey a sheet; and sensors 157*a* and 157*b* for detecting the sheet. In order to discharge, to the discharge tray 230, a cut-sheet fed from the paper supply tray 210, the cut-sheet is sandwiched by the sub-roller 151 and the coupled rollers 152*a*, 152*b* and 152*c*, and is invertedly conveyed along a U-shaped path. Further, in order to discharge, to the discharge tray 230, roll paper sheets fed by the paper supply portion 130, the roll paper sheets are sandwiched and conveyed by the sub-roller 151 and the coupled roller 152*c*.

The feeding roller 153 and the coupled roller 154 sandwich the cut-sheet that is invertedly conveyed, or the roll paper sheet that is supplied, and convey the sheet to a platen 163. The discharge roller 155 and the serrated roller 156 sandwich the sheet that is passed through the platen 163, and discharge the sheet to the discharge tray 230. The sensor 157*a* detects the distance the cut-sheet is conveyed in order to remove skewing, and the sensor 157*b* detects the distance that the cut-sheet is invertedly conveyed, or the roll paper is supplied, in order to perform a search for the head of the paper.

The recording portion 160 includes a carriage 161 and the recording head 162. The carriage 161 is connected to a carriage belt (not shown), and when the carriage belt is activated by a carriage driver (not shown), the carriage 161 interlocks with the movement of the carriage belt and reciprocates along a guide shaft (not shown).

The recording head 162 includes a plurality of black recording heads for ejecting two types of black ink, for example, and a plurality of color recording heads for ejecting six differently colored inks, yellow, dark yellow, cyan, light cyan, magenta and light magenta. Nozzle openings that communicate with pressure generation chambers are provided for the recording head 162, and when a predetermined pressure is applied to ink that is retained in the pressure generation chambers, ink droplets having designated sizes are ejected from the nozzle openings onto paper.

An explanation will now be given for the operation of the thus-arranged ink-jet printer 100 for printing cut-sheets. A set of cut-sheets P, which is stacked on the paper supply tray 210 of the paper supply/discharge tray 200 attached to the paper supply/discharge portion 140, is pressed against the paper feeding roller 142 when the hopper 141 is raised as the compression spring 144 mechanically recovers in synchronization with the rotation of the paper feeding roller 142. Then, only the topmost cut-sheet P is separated by the separation member 143 and is supplied to the conveying portion 150.

Figure 15A:
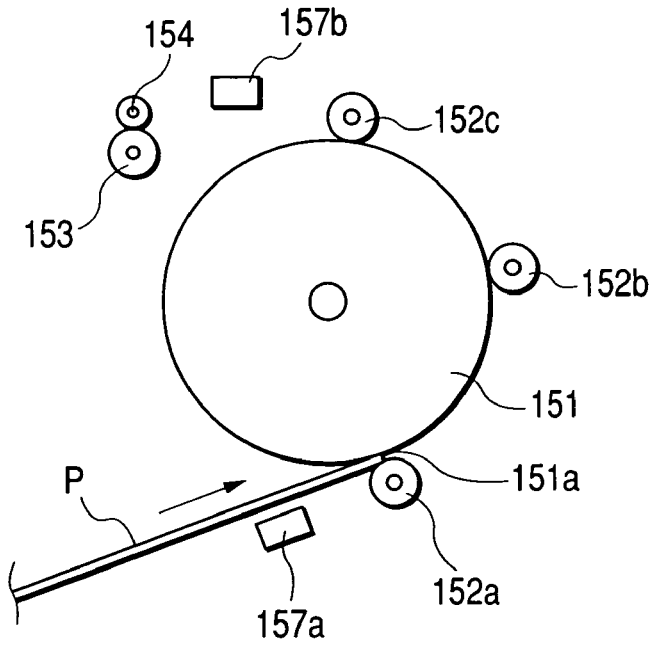
FIGS. 15A and 15B are first diagrams showing the state wherein paper is conveyed by the ink-jet printer in FIG. 1.

When, as is shown in FIG. 15A, this cut-sheet P reaches the contact point 151*a* between the sub-roller 151 and the coupled roller 152*a*, skewing of the cut-sheet P is removed. At this time, different skewing removal methods may be employed, depending on the thickness of the paper. As one method for handling a cut-sheet that is thinner than plain paper, a small portion of the leading edge of the cut-sheet is held between the sub-roller 151 and the coupled roller 152*a*, and thereafter, the rollers 151 and 152*a* are rotated in reverse to deflect the cut-sheet. In this manner, the leading edge of the cut-sheet can be aligned and skewing removed.

For a cut-sheet that is thicker than plain paper, the leading edge of the cut-sheet abuts upon the contact portion 151*a* between the sub-roller 151 and the coupled roller 152*a*, and the paper feeding roller 142 slips, so that the leading edge of the cut-sheet is aligned and skewing is removed. The length of the cut-sheet that is held and the length of the cut-sheet that is in contact the contact portion 151*a* are detected by the sensor 157*a*, and in consonance with the detected lengths, the skewing removal operation is controlled.

The skewing removal method differs depending on the thickness of the paper, because a thin cut-sheet is poor, fragile paper, and the paper feeding roller 142 would feed out the cut-sheet without slipping thereon. Furthermore, since a thick cut-sheet is made by gluing together thin cut-sheets, the thin cut-sheets would be peeled apart when the rollers 151 and 152*a* are reversely rotated.

Figure 15B:
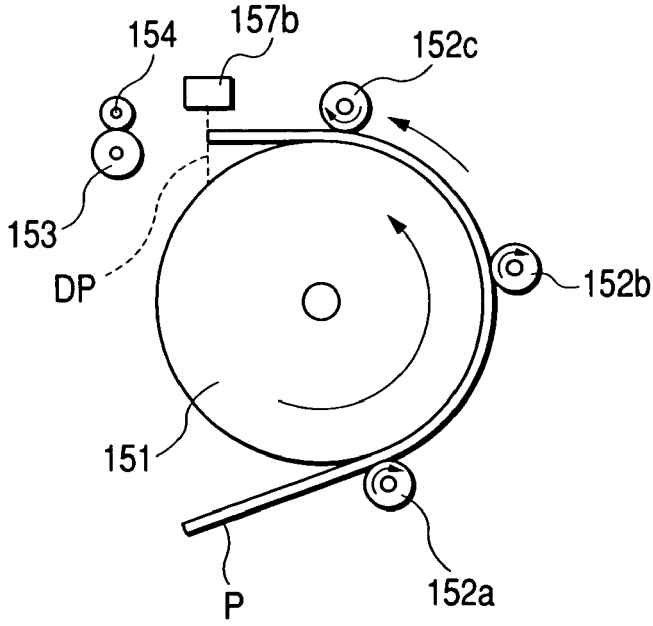

After the skewing removal has been completed, the cut-sheet P is sandwiched between the sub-roller 151 and the coupled rollers 152*a*, 152*b* and 152*c*, which are driven by a feeding motor (not shown), and is inverted along the U-shaped path, i.e., is conveyed in the direction opposite to the paper feeding direction. When, as is shown in FIG. 15B, the leading edge of the cut-sheet P reaches a detection position DP for the sensor 157*b*, the head search process, the process used to position the cut-sheet P for the start of printing, is performed.

Figure 16A:
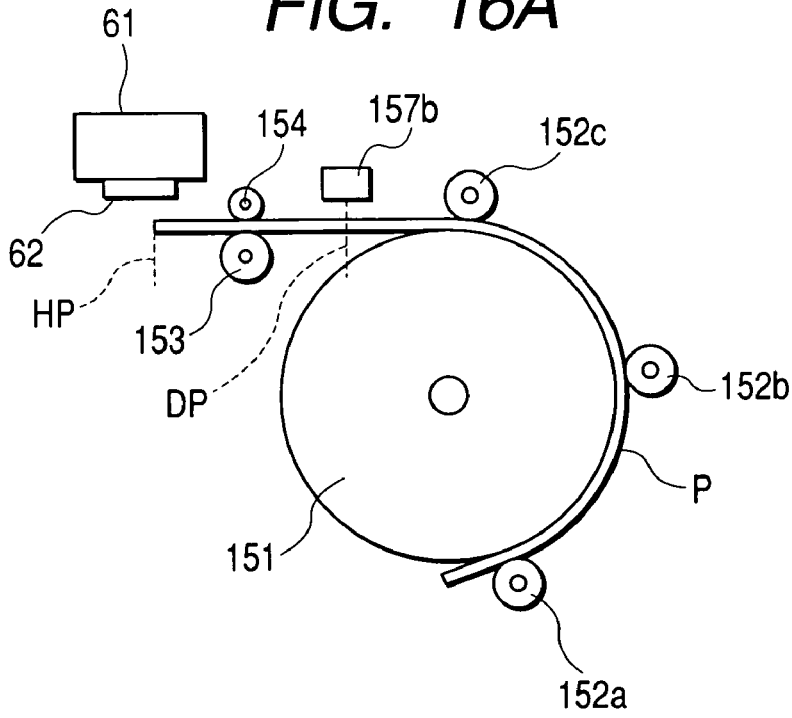
FIGS. 16A and 16B are second diagrams showing the state wherein paper is conveyed by the ink-jet printer in FIG. 1.

That is, the sensor 157*b* detects the distance the cut-sheet P must be conveyed before the leading edge is moved from the detection position DP, and is passed between the feeding roller 153 and the coupled roller 154 and reaches a head position HP shown in FIG. 16A. In accordance with the detected distance, the head search is performed. A conventional head search process is performed by the sensor 157*a* that is located upstream of the sub-roller 151. In this embodiment, however, since the head search is performed by the sensor 157*b* located downstream of the sub-roller 151, the detected distance is reduced. And especially, a head search error due to the thickness of the paper can be eliminated, and the accuracy of the head search can be increased.

Figure 16B:
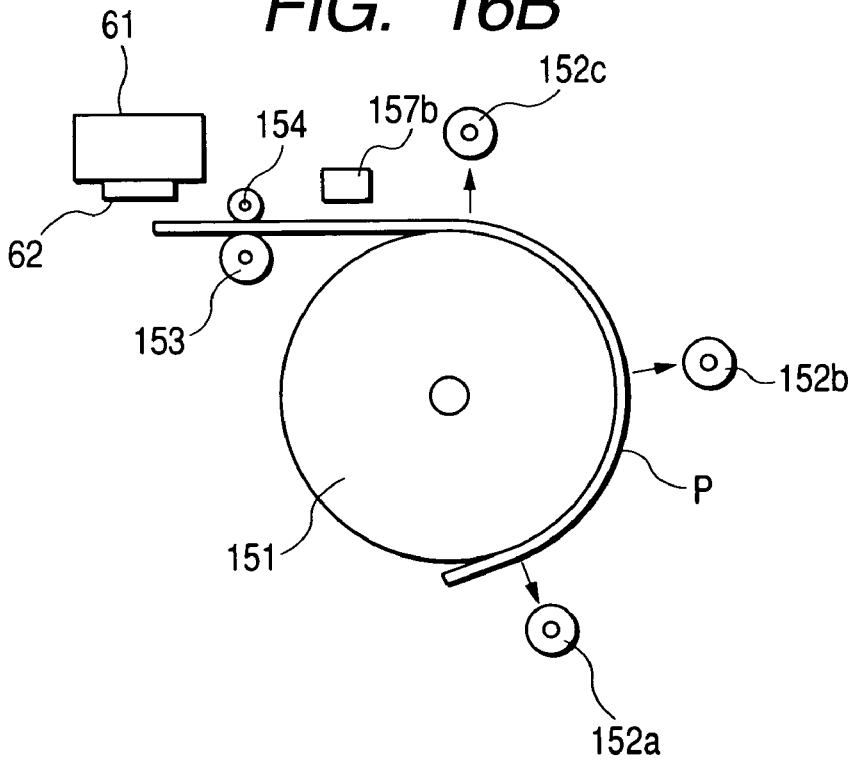

Then, after the head search has been completed, the cut-sheet P is sandwiched between the feeding roller 153 and the coupled roller 154 that are driven by the feeding motor (not shown), and is conveyed to the recording portion 160. Since when the cut-sheet P is sandwiched between the sub-roller 151 and the coupled rollers 152*a*, 152*b* and 152*c* deterioration of the conveying accuracy occurs, the coupled rollers 152*a*, 152*b* and 152*c* are released from the sub-roller 151, as is shown in FIG. 16B.

The cut-sheet P to be conveyed is attracted to and flattened on the platen 163 by a suction pump (not shown), and printing is performed by the recording head 162 that is mounted on the carriage 161 and is driven by a carriage motor and a timing belt (neither of them shown). At this time, the controller of the ink-jet printer 100 supplies to the recording head 162 seven colors of ink, such as yellow, dark yellow, magenta, light magenta, cyan, light cyan and black, from the ink cartridges; controls the ejection timings for the colored ink and drives the carriage 161 and the feeding roller 153; and accurately performs the ink-dot control and the half-tone processing. Thereafter, the printed cut-sheet P is sandwiched between the discharge roller 155 and the serrated roller 156, which are driven by the feeding motor (not shown), and is discharged to the paper supply/discharge portion 140 and stacked on the discharge tray 230 of the paper supply/discharge tray 200.

As is described above, for the discharge tray 230 of the paper supply/discharge tray 200 in this embodiment, the paper roll guide portion 240 is provided, for the first discharge member 239*a*, to guide the paper from the discharge roller 155 to the discharge members 239*a*, 239*b*, 239*c* and 239*d*. Therefore, when there are steps between the discharge roller 155 and the discharge members 239*a*, 239*b*, 239*c* and 239*d*, the leading edge of the sheet to be discharged will not be caught between the steps, and can be guided toward the discharge members 239*a*, 239*b*, 239*c* and 239*d* so that it can be stacked correctly.

The paper roll guide portion 240 is stored in the first discharge member 239 to handle flat sheets, such as cut-sheets, or is extended at the discharge member 239*a* to handle sheets curled in the discharge direction, such as roll paper sheets. Since the paper roll guide portion 240 includes the second guidance plates 242, along which the paper is guided from the discharge roller 155 toward the discharge members 239*a*, 239*b*, 239*c* and 239*d*, flat sheets, such as cut-sheets, can be directly stacked on the discharge members 239*a*, 239*b*, 239*c* and 239*d*. Further, since a sheet, such as a roll paper sheet, curled in the discharge direction will not be caught between the discharge roller 155 and the discharge members 239*a*, 239*b*, 239*c* and 239*d*, and since the leading edge of the sheet is moved along the slide-like second guidance plates 242 and is guided to the discharge members 239*a*, 239*b*, 239*c* and 239*d*, the curled paper can be smoothly stacked.

The preferred embodiment of the present invention has been explained. However, the present invention is not limited to this embodiment, and can be applied for another embodiment without abandoning the claims of the invention described above. For example, in the embodiment of the invention, an ink-jet printer has been employed as a recording apparatus; however, the recording apparatus is not limited to this printer, and the invention can also be applied for another recording apparatus that employs a tray, such as a facsimile machine or a copier.

Furthermore, the invention can be applied not only for a recording apparatus, but also for a liquid ejection apparatus wherein, instead of ink, a liquid suitable for the operational purpose is ejected from a liquid ejection head onto a target medium and is attached to the medium, e.g., an apparatus comprising a color ejection head used for manufacturing color filters for liquid crystal displays, an electrode material (a conductive paste) ejection head used for the formation of electrodes for organic EL displays or face emitting displays (FEDS), a bioorganic compound ejection head used for biochip manufacturing, or a sample ejection head for use as a precision pipette.

What is claimed is:

1. A tray on which a discharged recording medium from a discharge portion is stacked comprising:

a medium stacking portion on which the recording medium is stacked;

a guide portion provided on the medium stacking portion at a position to which the recording medium is discharged, wherein the guide portion is configured to be retractable into or extendable from the medium stacking portion in accordance with a form of the recording medium, whereby the guide portion guides the recording medium so that the recording medium is transported from the discharged portion to the medium stacking portion; and wherein the guide portion includes a first guidance plate having in a rectangular shape and a second guidance plate.

2. A tray according to claim 1, wherein the guide portion includes a slanted member that guides the recording medium from the discharge portion down to the medium stacking portion.

3. A recording apparatus for the recording of a recording medium comprising:

a tray according to claim 1.

4. A liquid ejection apparatus for ejecting a liquid onto a target ejection medium comprising:

a tray according to claim 1.

5. A tray according to claim 1, wherein a length of the first guidance plate is substantially equal to a width of a first discharge member of the medium stacking portion.

6. A tray according to claim 1, wherein an end of the first guidance plate is pivotally attached to the medium stacking portion.

7. A tray according to claim 1, wherein the second guidance plate is pivotally attached to an end of the first guidance plate.

8. A tray, adapted to be attached to a discharging portion of an apparatus from which a medium is discharged in a first direction, the tray comprising:

a supporting face, adapted to support the medium; and at least one plate member, provided on the supporting face and being moveable between a first position and a second position, wherein:

the plate member is made flush with the supporting face when the plate member is placed in the first position;

a first end of the plate member is displaced in the first direction and a second end of the plate member is lifted from the supporting face, when the plate member is in a second position; and the supporting face is not moveable in a second direction orthogonal to the first direction when the plate member is moved between the first position and the second position.

9. The tray as set forth in claim 8, wherein:

the at least one plate member includes a plurality of plate members arrayed in a third direction orthogonal to the first direction and the second direction.

10. A recording apparatus, comprising:

a recording head, operable to record information on a recording medium;

a discharging portion, operable to discharge the recording medium in a first direction;

a tray, attached to the discharging portion to receive the recording medium discharged therefrom, the tray comprising:

a supporting face, adapted to support the discharged recording medium; and at least one plate member, provided on the supporting face and being moveable between a first position and a second position, wherein:

the plate member is made flush with the supporting face when the plate member is placed in the first position;

a first end of the plate member is displaced in the first direction and a second end of the plate member is lifted from the supporting face, when the plate member is placed in the second position; and the supporting face is not moveable in a second direction orthogonal to the first direction when the plate member is moved between the first position and the second position.

11. A liquid ejection apparatus, comprising:

a liquid ejection head, operable to eject liquid toward a target medium;

a discharging portion, operable to discharge the target medium in a first direction;

a tray, attached to the discharging portion to receive the target medium discharged therefrom, the tray comprising:

a supporting face, adapted to support the discharged target medium; and at least one plate member, provided on the supporting face and being moveable between a first position and a second position, wherein:

the plate member is made flush with the supporting face when the plate member is placed in the first position;

a first end of the plate member is displaced in the first direction and a second end of the plate member is lifted from the supporting face, when the plate member is placed in the second position; and the supporting face is not moveable in a second direction orthogonal to the first direction when the plate member is moved between the first position and the second position.

12. A tray, adapted to be attached to a discharging portion of an apparatus from which a medium is discharged in a first direction, the tray comprising:

a supporting face, adapted to support the medium and having a first width; and a plurality of plate members, each of which is provided on the supporting face and has a second width narrower than the first width, the plate members being moveable between a first position and a second position, wherein:

one end of each of the plate members is lifted from the supporting face to be adapted to guide the medium discharged from the discharging portion to the supporting face, in the second position.

13. A recording apparatus, comprising:

a recording head, operable to record information on a recording medium;

a discharging portion, operable to discharge the recording medium in a first direction;

a tray, attached to the discharging portion to receive the recording medium discharged therefrom, the tray comprising:

a supporting face, adapted to support the medium and having a first width; and a plurality of plate members, each of which is provided on the supporting face and has a second width narrower than the first width, the plate members being moveable between a first position and a second position, wherein:

one end of each of the plate members is lifted from the supporting face to be adapted to guide the medium discharged from the discharging portion to the supporting face, in the second position.

* * * * *